US007067744B2

(12) United States Patent
Mere et al.

(10) Patent No.: US 7,067,744 B2
(45) Date of Patent: Jun. 27, 2006

(54) KNOB ASSEMBLY

(75) Inventors: Shadi Mere, Ypsilanti, MI (US); Douglas Allen Pfau, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/826,013

(22) Filed: Apr. 16, 2004

(65) Prior Publication Data

US 2005/0230227 A1 Oct. 20, 2005

(51) Int. Cl.
*H01H 9/00* (2006.01)
*H01H 19/14* (2006.01)

(52) U.S. Cl. ..... 200/4; 200/18; 200/570

(58) Field of Classification Search ..... 200/4, 200/1 R, 6 B, 6 BB, 6 R, 11 R, 11 EA–11 H, 200/11 TW, 562–572, 291, 292, 5 A, 5 R
See application file for complete search history.

(56) References Cited

U.S. PATENT DOCUMENTS 2,876,313 A 3/1959 Dull et al.
2,967,215 A 1/1961 Whiting
2,970,199 A * 1/1961 Dull et al. ..... 200/569
4,539,444 A 9/1985 Senoh
4,551,587 A * 11/1985 Rose ..... 200/11 R
5,315,077 A 5/1994 Simon et al.
5,794,766 A * 8/1998 Morita et al. ..... 200/569
6,236,002 B1 5/2001 Chou
6,262,378 B1 * 7/2001 Chou ..... 200/4

* cited by examiner

*Primary Examiner*—Elvin G. Enad
*Assistant Examiner*—M. Fishman
(74) *Attorney, Agent, or Firm*—Brinks Hofer Gilson & Lione

(57) ABSTRACT

A knob for an instrument panel is provided having a body portion, a first end portion adjacent to the body portion, and a second end portion adjacent to the body portion and defining a generally wave-shaped surface. The wave-shaped surface includes a plurality of peaks and a plurality of troughs, the peaks extending away from the body portion in a direction generally parallel to a longitudinal axis of the body portion. An adjustment assembly may also be provided having a first contact member with a contact portion, a second contact member with a contact portion, and an adjustment member with a plurality of protrusions. The protrusions are configured to selectively engage the contact portion of the first contact member and induce an electrical connection, and to selectively engage the contact portion of the second contact member and induce a second electrical connection.

19 Claims, 3 Drawing Sheets

KNOB ASSEMBLY

BACKGROUND

The present invention relates generally to an instrument panel and, more particularly, to an adjustment assembly for the instrument panel. The adjustment assembly is of the type that generates electrical signals based on user inputs.

An important function of an adjustment or knob assembly, such as those found on the instrument panel of an automobile, is to communicate user input to a controller, which then carries-out the user's commands. Currently, some electrical adjustment assemblies communicate user input via a group of contact members having living hinges, each contact member located along an arc with a different radius. The contact members are selectively engaged by protrusions located on a working side of a knob along the corresponding arcs. The protrusions and contact members cooperate to create different combinations of engaged and disengaged electrical connections, which correspond to various knob positions or settings. However, this type of configuration includes numerous components and part complexity, causing additional manufacturing steps and potential premature system failure.

It is therefore desirable to reduce the part complexity and increase the reliability of an electrical adjustment or knob assembly.

Another important function of an electrical knob assembly is to create a series of indexing points, tactile indict, or detects that the instrument panel operator can feel during knob adjustment in order to indicate that a signal has been sent to the controller. Currently, electrical adjustment assemblies include an adjustment means to send a signal to the controller and a separate indexing means to indicate to the user that a signal has been sent. However, this configuration may also include numerous components and part complexity, causing additional manufacturing steps and potential premature system failure.

Therefore, it is further desirable to reduce the part complexity and increase the reliability of an indexing means for an electrical adjustment assembly.

SUMMARY

In overcoming the disadvantages of the known technology, the current invention provides an assembly that improves the reliability and decreases part complexity of an electrical adjustment or knob assembly.

In one aspect, the current invention is a knob assembly for an instrument panel or other device. The knob assembly includes a generally cylindrical knob body having a longitudinal axis about which it is intended to rotate. A back face or rim of this body defines a generally wave-shaped surface having a series of peaks and troughs. These peaks are defined as extending away from the knob body in a direction generally parallel to the longitudinal axis of the knob body. The wave-shaped surface may be generally defined by a sinusoidal function.

In another aspect, the knob assembly includes a first contact member with a first contact portion, a second contact member with a second contact portion and an adjustment member, such as a knob. The adjustment member includes a plurality of protrusions that selectively engage the first contact portion in order to induce a first electrical connection. The protrusions also selectively engage the second contact portion in order to induce a second electrical connection. Additionally, at least one of the first and second contact members is configured to bias the adjustment member towards an equilibrium position.

In yet another aspect, the present invention includes an adjustment or knob assembly having a first contact member with a first contact portion and knob body. A back face or rim of the knob body defines a generally wave-shaped surface having a plurality of peaks and troughs. The peaks selectively engage the first contact portion of the first contact member to induce a first electrical connection. The adjustment assembly may further include a second contact member with a second contact portion, in which case the peaks also selectively engage the second contact portion to induce a second electrical connection.

Adjacent peaks on the knob body are located a predetermined distance apart. The first contact portions of the first contact member and the second contact portion of the second contact member are also located a predetermined distance apart; in which case the former predetermined distance is different than the latter predetermined distance. The knob body and the first contact portion may also include matting surfaces; in which case the respective matting surfaces cooperate to form a matting connection. Additionally, the knob assembly may include a bracket that rotatably receives the adjustment member, such as by receiving a plurality of connector arms in a snap-fit connection.

DETAILED DESCRIPTION

Figure 1:
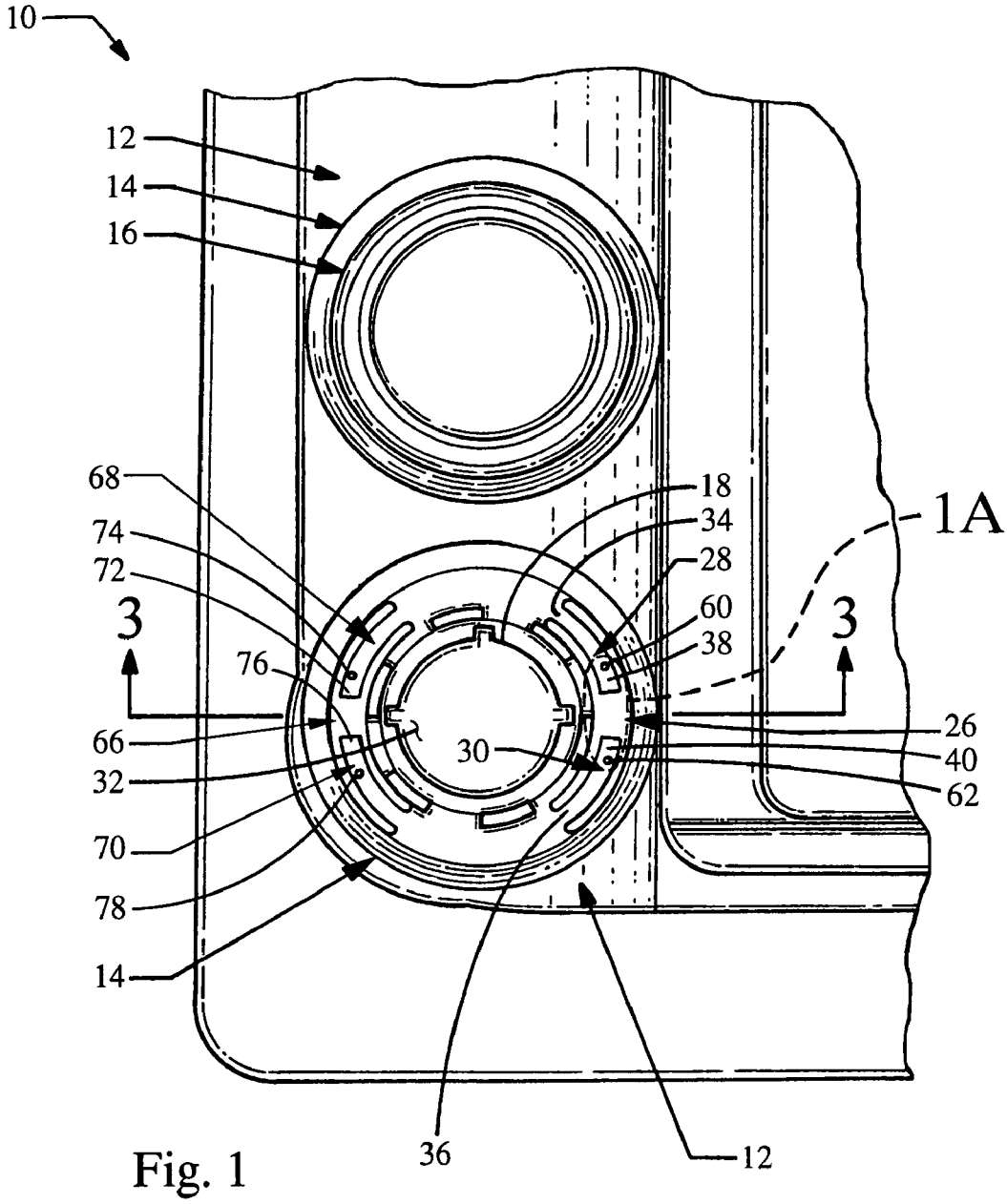
FIG. 1 is a plan view of a instrument panel embodying the principles of the present invention and showing a first adjustment assembly having a knob and a bezel and second adjustment assembly with the knob removed for illustration purposes.
Figure 1A:
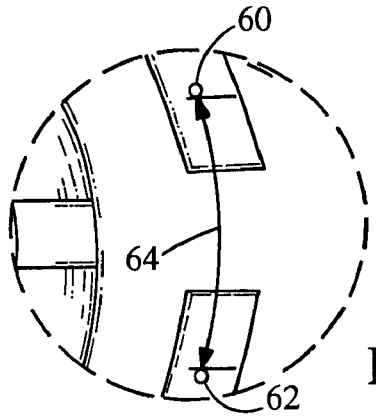

Referring now to FIG. 1, seen therein is a portion of an instrument panel 10 having both a fully-assembled adjustment assembly 12 and a partially-assembled adjustment assembly 12 having a knob 16 removed for illustrative purposes. The knob 16 is rotatably received by the bezel 14, as will be discussed further below, in order to communicate inputs from a user of the assembly 12 to a controller (not shown). More specifically, as the instrument panel user rotates the knob 16, electrical connections are engaged and disengaged in order to send a signal of the user's desired input to the controller.

As shown by the partially assembled adjustment assembly 12 the bezel 14 includes a bracket 18 that rotatably receives the knob 16. The partially assembled adjustment assembly 12 has a first pair of contact members 26 including a first contact member 28 and a second contact member 30. The first and second contact members 28, 30 selectively engage a contact board 32 in order to form electrical connections. The contact board 32 may be a printed circuit board, but any appropriate device that permits engagement and disengagement of electrical connections may be used. The contact members 28, 30 are preferably comprised of a plastic material; in which case the contact members 28, 30 include an electrically conductive portion (not shown) in order to complete an electrical circuit within the contact board 32. In one alternative, the contact members 28, 30 are comprised of an electrically conductive material in order to complete the electrical circuit. In another alternative, the contact members 28, 30 contact and move an electrically conductive bridging member (not shown) that completes the electrical circuit.

In the illustrated embodiment of FIG. 1, each of the contact members 28, 30 is a generally resilient finger having a base portion 34, 36 at one end of the finger and a contact portion 38, 40 at the other end of finger. The base portions 34, 36 are connected to the bezel 14 and serve as the pivoting point for the respective contact members 28, 30. More specifically, the base portions 34, 36 are preferably living hinges permitting resilient rotation between the contact members 28, 30 and the bezel 14. In the illustrated embodiment of FIG. 1, the bezel 14 and the contact members 28, 30 are formed from one unitary structure. The contact members 28, 30 could alternatively be connected to the bezel 14 via an appropriate fastener or adhesive. The contact portions 38, 40 of the contact members 28, 30 are near a free end of the contact members 28, 30 in order to freely pivot about the respective bases 34, 36.

Each of the contact portions 38, 40 preferably includes a matting surface such as a projection 60, 62. The projections 60, 62 are the highest-elevated points along a line parallel with the longitudinal axis 22. The projections 60, 62 in FIG. 1 are generally hemispherical.

The bezel 14 preferably includes a second pair of contact members 66 including a third contact member 68 and fourth contact member 70. Similarly to the first pair of contact members 26, the third contact member includes a contact portion 72 and a projection 74 and the fourth contact member 70 includes a contact portion 76 and a projection 78. Alternatively, the bezel 14 only includes the first pair of contact member 26.

Figure 2:
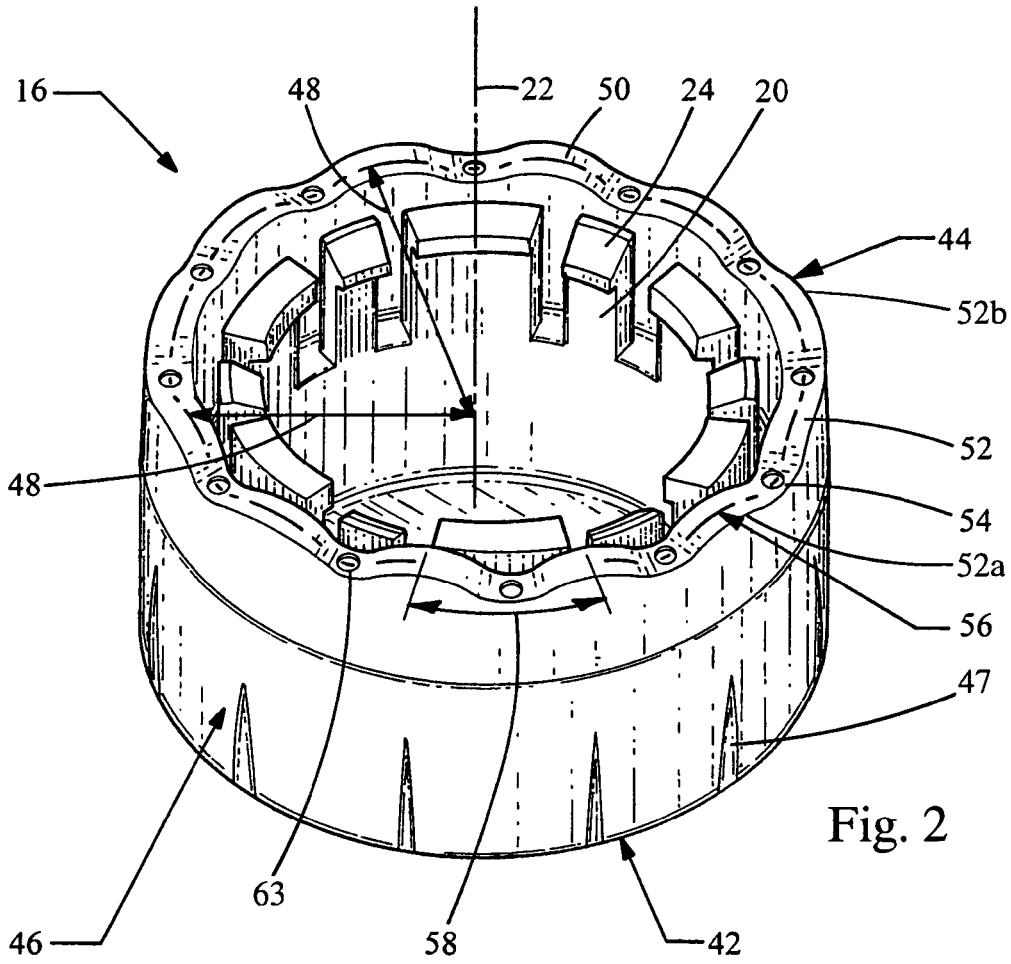
FIG. 2 is a rear perspective view of the knob shown in FIG. 1.

Referring now to FIG. 2, the knob 16 includes at least one connector arm 20 extending along the inner surface of the knob 16 in a direction parallel with the longitudinal axis 22. The connector arm 20 also includes a tab 24 at one end of the connector arm 20 in order to form a snap-fit connection with the bracket 18. The knob 16 preferably includes a plurality of connector arms 20 in order to permit the knob 16 to have a consistent feel during rotation about the longitudinal axis 22.

The knob 16 includes a front end 42 exposed to the instrument panel operator, a back end 44 not exposed to the instrument panel operator, and a side portion 46 connecting the respective ends 42, 44. The side portion 46 of the knob 16 is preferably cylindrical-shaped with a constant radius 48 and includes a plurality of ridges 47 or other projections in order to improve griping of the knob 16.

The back end 44 of the knob 16 preferably defines a wave-shaped surface having a plurality of peaks 52 and troughs 54. The peaks 52 are defined as the portions of the protrusions 50 that are located furthest from the first end 42 of the knob 16 along a line parallel with the longitudinal axis 22, and the troughs 54 are defined as the areas between the peaks 52 and that are closest to the first end 42 of the knob 16 along a line parallel to the longitudinal axis 22. As shown in FIG. 2, the wave-shaped surface of the second end 44 is preferably defined by a sinusoidal function 56. This creates a consistent feel for the user during rotatior of the knob assembly 10 and such that each predetermined angle of rotation that the knob 16 is rotated will cause a signal to be sent to the controller.

The back end 44 of the knob 16 defines a plurality of protrusions 50 extending in a direction substantially parallel to the longitudinal axis 22 of the knob 16. When the knob 16 is connected to the bezel 14, the protrusions 50 selectively engage the contact portions 38, 40 of the contact members 28, 30 to induce an electrical connection between electrical conductors (not shown) in the contact board 32. Therefore, as the knob 16 rotates about the longitudinal axis 22 the protrusions 50 engage and disengage the contact portion 38, 40, thus completing and disconnecting electrical connections in the contact board 32.

As shown in FIG. 2, the troughs 54 of the knob 16 preferably includes a hemispherical receptacle 63 that receives the respective projections 60, 62 when the peak 52 is located between the respective contact members 28, 30. The receptacle 63 may have any appropriate shape and may match the shape of the projections 60, 62. The hemispherical receptacles 63 may operate as reservoirs for grease and/or dirt in order to decrease the friction between the knob 16 and the contact members 28, 30.

Figure 3A:
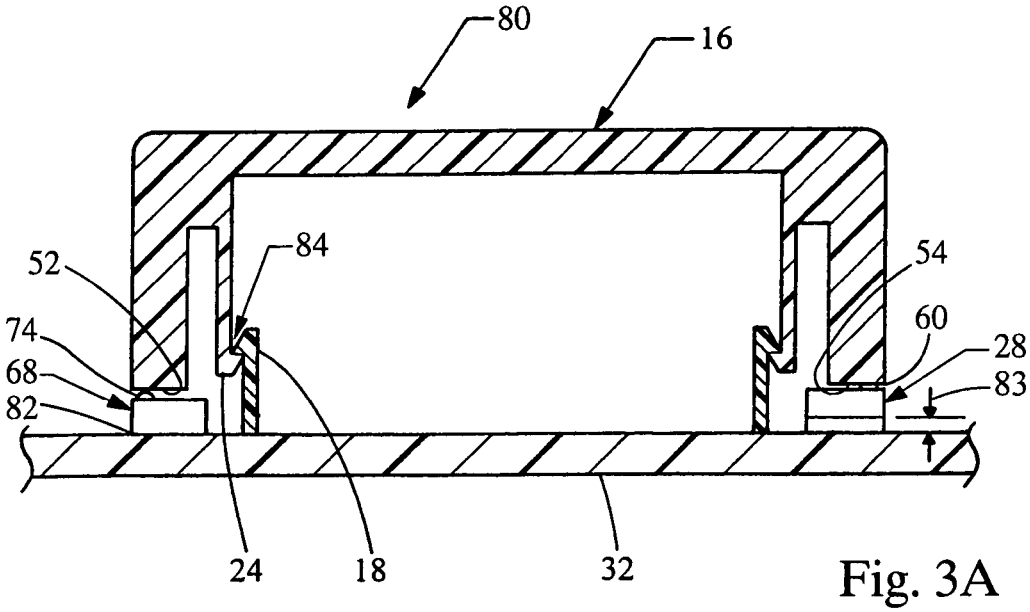
FIG. 3*a* is a cross sectional view taken generally along line 3—3 in FIG. 1 and showing an additional knob attached to the bezel of the second adjustment assembly and in a first position.

As shown in FIG. 3*a*, the tab 24 of the knob 16 and the bracket 18 of the bezel 14 form a snap-fit connection 84 in order to connect the knob 16 and the bezel 14. More specifically, the tab 24 and the bracket 18 each have an opposing face. The two faces are generally parallel to each other and generally perpendicular to the longitudinal axis 22 in order to engage the knob 16 and the bracket 18 with each other.

During operation of the instrument panel 10, an electrical circuit in selective contact with the first contact member 28 is completed when one of the peaks 52 is aligned with the contact portion 38 of the first contact member 28, and the electrical circuit is not complete when one of the troughs 54 is aligned with the contact portion 38 of the contact member 28.

The controller is preferably able to determine the direction that the knob 16 is being rotated based on: the timing of the contact portions 38, 40 engaging the contact board 32; the distance between the peak 52 of one of the protrusions 50 and the peak 52 of an adjacent protrusion 50; and distance between the contact portions 38, 40 of the respective contact members 28, 30. The controller determining the direction that the knob 16 is being rotated will now be discussed in more detail.

First of all, as shown in FIG. 2, the distance between the peak 52 of one of the protrusions 50 and the peak 52 of an adjacent protrusion 50 is defined as the wave length. The wave length 58 determines the angle of rotation necessary to adjust the knob 16 by one setting level. For example, if the knob 16 controls volume for a device (not shown) the wave length 58 controls the angle of rotation that is necessary in order to adjust the volume level of the device by one increment. As mentioned above, each predetermined angle of rotation that the knob 16 is rotated will cause a signal to be sent to the controller. As a result, the wave lengths 58 between adjacent protrusions 50 are generally equal to each other so that the peaks 52 are generally equally-spaced along the knob 16.

Secondly, referring back to FIG. 1, the projections 60, 62 contact the peaks 52 of the knob 16 during rotation of the knob 16. The distance between the projection 60 and the projection 62 is defined as the contact surface distance 64.

Finally, the contact surface distance 64 is preferably smaller than the wave length 58 so the controller can determine the direction that the knob 16 is being rotated based on the timing of the contact portions 38, 40 engaging the contact board 32. For example, when neither of the contact members 28, 30 are in contact with the contact board 32, one of the peaks 52 is located between the respective contact members 28, 30. Therefore, as the knob 16 is rotated, the peak 52 that was located between the contact members 28, 30 will contact one of the projections 60, 62 depending on the direction of the rotation. If the knob 16 is turned clockwise, then the peak 52 that was located between the respective contact members 28, 30 will first contact the projection 62 and the trailing peak 52*b* will subsequently contact the projection 60. Similarly, if the knob 16 is rotated in a counter-clockwise direction, the peak 52 will contact the projection 60 and the leading peak 52*a* will contact the projection 62. If the wave length 50 was the same distance as the contact surface distance 64, then the peak 52 will contact the projection 62 at the same time that the trailing peak 52*b* contacts the projection 60 a sequence, and therefore direction of rotation could not be deferred. Therefore, the wave length 58 and the contact surface distance 64 are preferably unequal.

FIG. 3*a* shows the knob in a first position 80 where one of the peaks 52 is in aligned with the projection 74 of the third contact member in order to form a first electrical connection 82. Additionally, one of the troughs 54 is in aligned with the projection 60 on the first contact member 28, such that the first contact member 28 is separated a distance 83 from the contact board 32 and an electrical connection is not completed.

Figure 3B:
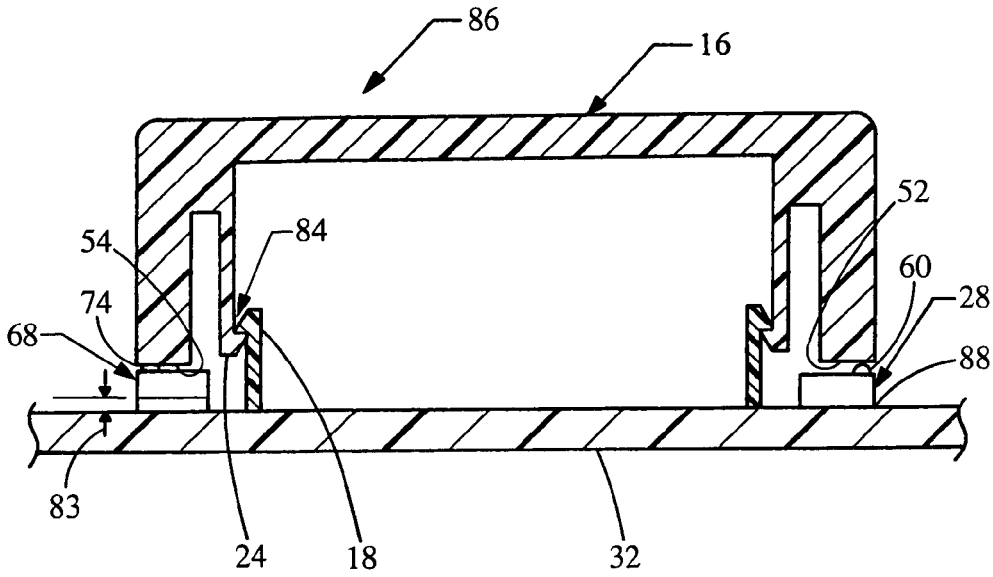
FIG. 3*b* is a cross sectional view taken generally along line 3—3 in FIG. 1 and showing the knob in a second position.

FIG. 3*b* shows the knob 16 in a second position 86 where one of the peaks 52 is in aligned with the projection 60 of the first contact member 28 in order to induce a second electrical connection 88 with the contact board 32. Additionally, one of the troughs 54 is in aligned with the projection 74 of the third contact member 68 such that the third contact member 68 is separated a distance 83 from the contact board 32 and an electrical connection is not completed.

Figure 3C:
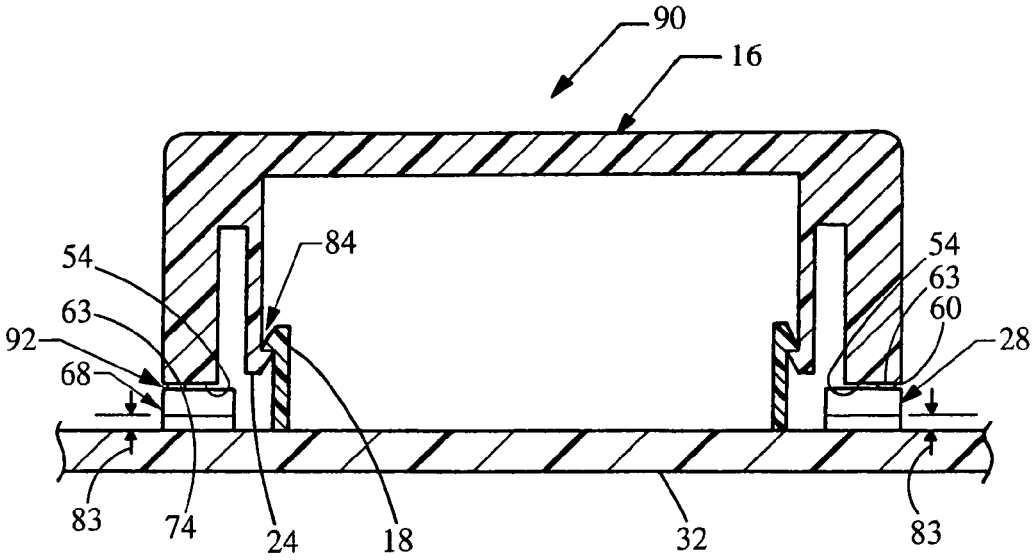
FIG. 3*c* is a cross sectional view taken generally along line 3—3 in FIG. 1 and showing the knob in a third position.

FIG. 3*c* shows the knob 16 in a third position 90 where neither the first contact member 28 nor the third contact member 68 are in electrical connection with the contact board 32. The third position 90 is considered to be an equilibrium position because the projection 60 and the hemispheric al receptacle 63 form a mating connection 92 and the projection 74 and the hemispheric al receptacle 63 form a mating connection 92. The mating connections 92 act as an indexing means by providing a slight resistance to rotation of the knob 16 in order to indicate to the operator that the knob 16 is located at particular setting. This resistance or tactile indict permits the operator to feel each setting or level of the adjustment assembly 12.

In the third position 90, the respective contact members 28, 30, 68, 70 bias the knob 16 towards an equilibrium position. More specifically, the respective contact members 28, 30, 68, 70 are biased such as to move in direction away from the contact board 32 substantially parallel to the longitudinal axis 22, thus creating a spring force acting on the back end 44 of the knob 16. When one of the peaks 52 is in contact with a respective contact member 28, 30, 68, 70 the spring force is greater due to the large deflection of the contact member 28, 30, 68, 70. Thus, the knob 16 becomes more difficult to rotate as one of the peaks 52 aligns with one of the contact members 28, 30, 68, 70. Additionally, the shape of the peaks 52 and troughs 54 may generate a rotational force perpendicular to the longitudinal axis 22 based on the angle of contact between the back end 44 of the knob 16 and the respective contact member 28, 30, 68, 70. Therefore, the respective contact members 28, 30, 68, 70 will tend to rotate the knob 16 in a clockwise or a counter-clockwise direction and into the equilibrium position 90.

It is therefore intended that the foregoing detailed description be regarded as illustrative rather than limiting, and that it be understood that it is the following claims, including all equivalents, that are intending to define the spirit and scope of this invention.

The invention claimed is:

1. An adjustment assembly for an instrument panel, the adjustment assembly comprising:

a first contact member having a contact portion;

a second contact member having a contact portion: and an adjustment member having a plurality of generally ecually-spaced protrusions located along a generally circular, continuous path and a plurality of troughs located between adjacent protrusions;

wherein the protrusions are configured to selectively engage the contact portion of the first contact member and induce a first electrical connection and are configured to selectively engage the contact portion of the second contact member and induce a second electrical connection;

wherein the troughs receive the first contact member when the first electrical connection is disconnected and receive the second contact member when the second electrical connection is disconnected;

wherein at least one of the first contact member and the second contact member is configured to bias the adjustment member towards an equilibrium position.

2. The adjustment assembly of claim 1, wherein the contact portion of The first contact member includes a mating surface.

3. The adjustment assembly of claim 2, wherein the adjustment member includes a mating surface, wherein the mating surface of the first contact member and the mating surface of the adjustment member cooperate to form a mating connection.

4. The adjustment assembly of claim 1, further comprising a bracket configured to rotatably receive the adjustment member.

5. The adjustment assembly of claim 4, wherein the adjustment member includes a plurality of connector arms configured to form a snap-fit connection with the bracket.

6. The adjustment assembly of claim 1, wherein the first contact member and the second contact member are comprised of plastic material.

7. An adjustment assembly for an instrument panel, the adjustment assembly comprising:

a first contact member having a contact portion; and an adjustment member having a first end and a second end, the second end defining a generally wave-shaped surface extending contiruously along a circular path and having a plurality of generally equally-spaced peaks and a plurality of troughs located between adjacent peeks;

wherein the peaks are configured to selectively engage the contact portion of the first contact member inducing a first electrical connection and wherein the troughs receive the first contact member when the first electrical connection is disconnected.

8. The adjustment assembly of claim 7, further comprising a second contact member having a contact portion, wherein the peaks are configured to selectively engage the contact portion of the second contact member inducing a second electrical connection.

9. The adjustment assembly of claim 8, wherein a first peak of the plurality of peaks and a second peak of the plurality of peaks are adjacent to each other and are located a first distance from each other, the contact portion of the first contact member and the contact portion of the second contact member are located a second distance from each other, and the first distance is greater than the second distance.

10. The adjustment assembly of claim 8, wherein the adjustment member has a plurality of equilibrium positions with respect to the first contact member and the second contact member.

11. The adjustment assembly of claim 8, wherein the adjustment member includes a knob.

12. The adjustment assembly of claim 11, wherein the first contact member includes an arm portion configured to pivot about a base portion and the second contact member includes an arm portion configured to pivot about a base portion.

13. The adjustment assembly of claim 7, wherein the contact portion of the first contact member includes a mating surface.

14. The adjustment assembly of claim 13, wherein the adjustment member includes a mating surface, wherein the mating surface of the first contact member and the mating surface of the adjustment member cooperate to form a mating connection.

15. The adjustment assembly of claim 14, wherein the mating surface of the first contact member is a generally spherical projection and the mating surface of the adjustment member is a generally spherical receptacle.

16. The adjustment assembly of claim 7, wherein the generally wave-shaped surface is generally defined by a sinusoidal function.

17. The adjustment assembly of claim 7, further comprising a bracket configured to rotatably receive the adjustment member.

18. The adjustment assembly of claim 17, wherein the adjustment member includes a plurality of connector arms configured to form a snap-fit connection with the bracket.

19. The adjustment assembly of claim 8, wherein the first contact member and the second contact member are comprised of plastic material.

* * * * *

UNITED STATES PATENT AND TRADEMARK OFFICE

CERTIFICATE OF CORRECTION

PATENT NO. : 7,067,744 B2
APPLICATION NO. : 10/826013
DATED : June 27, 2006
INVENTOR(S) : Shadi Mere et al.

It is certified that error appears in the above-identified patent and that said Letters Patent is hereby corrected as shown below:

Column 6, in claim 1, line 6, delete "ecually-spaced" and substitute --equally-spaced-- in its place.

Column 6, in claim 2, line 2, after "portion of" delete "The" and substitute --the-- in its place.

Column 6, in claim 7, line 6, after "surface extending" delete "contiruously" and substitute --continuously-- in its place.

Signed and Sealed this

Twenty-sixth Day of December, 2006

JON W. DUDAS
*Director of the United States Patent and Trademark Office*